US010259225B2

(12) United States Patent
Araki et al.

(10) Patent No.: US 10,259,225 B2
(45) Date of Patent: Apr. 16, 2019

(54) RECORDING HEAD AND INK-JET RECORDING APPARATUS PROVIDED WITH THE SAME

(71) Applicant: KYOCERA Document Solutions Inc., Osaka (JP)

(72) Inventors: Takuma Araki, Osaka (JP); Kenichi Satake, Osaka (JP); Yasutaka Inui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/850,917

(22) Filed: Dec. 21, 2017

(65) Prior Publication Data

US 2018/0194141 A1 Jul. 12, 2018

(30) Foreign Application Priority Data

Jan. 6, 2017 (JP) ..... 2017-000942
Jan. 12, 2017 (JP) ..... 2017-003525

(51) Int. Cl.
*B41J 2/165* (2006.01)

(52) U.S. Cl.
CPC ..... *B41J 2/16552* (2013.01); *B41J 2/16508* (2013.01); *B41J 2/16538* (2013.01); *B41J 2/16544* (2013.01); *B41J 2/16585* (2013.01); *B41J 2002/16558* (2013.01)

(58) Field of Classification Search
CPC ..... B41J 2/16552; B41J 2/16544; B41J 2002/16558
See application file for complete search history.

(56) References Cited

U.S. PATENT DOCUMENTS

2006/0066663 A1* 3/2006 Takagi ..... B41J 2/16535 347/33
2012/0249673 A1* 10/2012 Mita ..... B41J 2/16552 347/33
2014/0204159 A1* 7/2014 Dooley ..... C09D 183/04 347/103

FOREIGN PATENT DOCUMENTS

JP 2007-83496 A 4/2007

* cited by examiner

*Primary Examiner* — Jason S Uhlenhake
(74) *Attorney, Agent, or Firm* — Stein IP, LLC

(57) ABSTRACT

A recording head is provided with an ink ejection surface and a cleaning liquid supply surface. The ink ejection surface includes a nozzle region in which a plurality of ink ejection nozzles for ejecting ink onto a recording medium are open. The cleaning liquid supply surface is provided, with respect to the nozzle region, on an upstream side in a wiping direction in which a wiper wipes the ink ejection surface, and a plurality of cleaning liquid supply ports for supplying a cleaning liquid are open through the cleaning liquid supply surface. On the cleaning liquid supply surface, at least in a region including the cleaning liquid supply ports, a hydrophilic region having wettability with respect to water higher than that of the ink ejection surface is formed substantially evenly across an entire region in a width direction thereof orthogonal to the wiping direction.

17 Claims, 13 Drawing Sheets

RECORDING HEAD AND INK-JET RECORDING APPARATUS PROVIDED WITH THE SAME

INCORPORATION BY REFERENCE

This application is based upon and claims the benefit of priority from the corresponding Japanese Patent Application No. 2017-000942 filed on Jan. 6, 2017 and the corresponding Japanese Patent Application No. 2017-003525 filed on Jan. 12, 2017, the entire contents of which are incorporated herein by reference.

BACKGROUND

The present disclosure relates to a recording head having an ink ejection nozzle for ejecting ink onto a recording medium such as a paper sheet, and to an ink-jet recording apparatus provided with the same.

An ink-jet recording apparatus that ejects ink to form images is capable of forming high-definition images and thus has been widely used as a recording apparatus such as a facsimile, a copy machine, or a printer.

In such an ink-jet recording apparatus, microscopic ink droplets (hereinafter, referred to as a mist) ejected together with ink droplets for image recording and a rebounded mist generated upon adhesion of the ink droplets to a recording medium adhere to an ink ejection surface of a recording head and is solidified. When the mist on the ink ejection surface is gradually increased to such an extent as to overlie an ink ejection nozzle, there might occur deterioration in linearity of ink ejection (flight deflection), failure of ink ejection, or the like, resulting in a decrease in printing performance of the recording head.

In many cases, the ink ejection surface has a water-repellent film formed thereon so that adherence of ink thereto is decreased. In a case of using water-based pigment ink, however, a repeated wiping operation by a wiper made of rubber causes pigment particles to act as an abrasive, thus causing the water-repellent film to be gradually ground away. As a result, it becomes likely that a mist adheres to the ink ejection surface, so that the ink ejection surface can no longer be kept clean.

As a solution to this, various methods for cleaning off a mist that has adhered to an ink ejection surface have been devised. For examples, there is known an ink-jet recording apparatus in which in order to clean an ink ejection surface of a recording head, a plurality of cleaning liquid supply ports are provided in a portion of the ink ejection surface on an outer side of a nozzle region in which a plurality of ink ejection nozzles are open (an upstream side in a wiping direction of a wiper). In this type of ink-jet recording apparatus, after a cleaning liquid is supplied through the cleaning liquid supply ports, the wiper is caused to move from an outer side beyond the cleaning liquid supply ports along the ink ejection surface, and thus the ink ejection surface can be wiped by using the wiper, while the wiper retains the cleaning liquid. In this manner, a recovery process for the recording head can be performed.

SUMMARY

A recording head according to one aspect of the present disclosure is provided with an ink ejection surface and a cleaning liquid supply surface. The ink ejection surface includes a nozzle region in which a plurality of ink ejection nozzles for ejecting ink onto a recording medium are open.

The cleaning liquid supply surface is provided, with respect to the nozzle region, on an upstream side in a wiping direction in which a wiper wipes the ink ejection surface, and a plurality of cleaning liquid supply ports for supplying a cleaning liquid are open through the cleaning liquid supply surface. On the cleaning liquid supply surface, at least in a region including the cleaning liquid supply ports, a hydrophilic region having wettability with respect to water higher than that of the ink ejection surface is formed substantially evenly across an entire region in a width direction thereof orthogonal to the wiping direction.

Still other objects of the present disclosure and specific advantages provided by the present disclosure will be made further apparent from the following description of embodiments.

DETAILED DESCRIPTION

Figure 1:
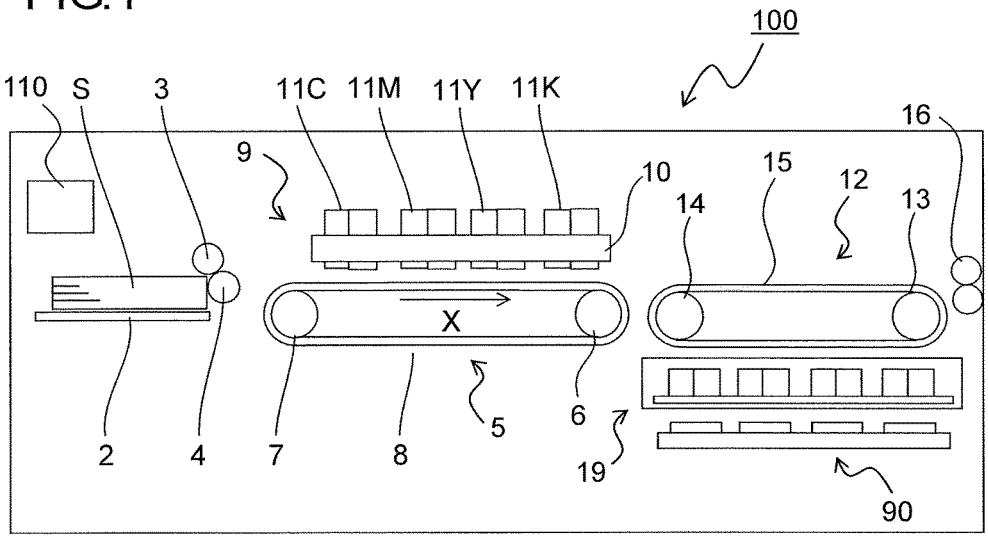
FIG. 1 is a schematic view showing a structure of an ink-jet recording apparatus provided with a recording head of the present disclosure.
Figure 2:
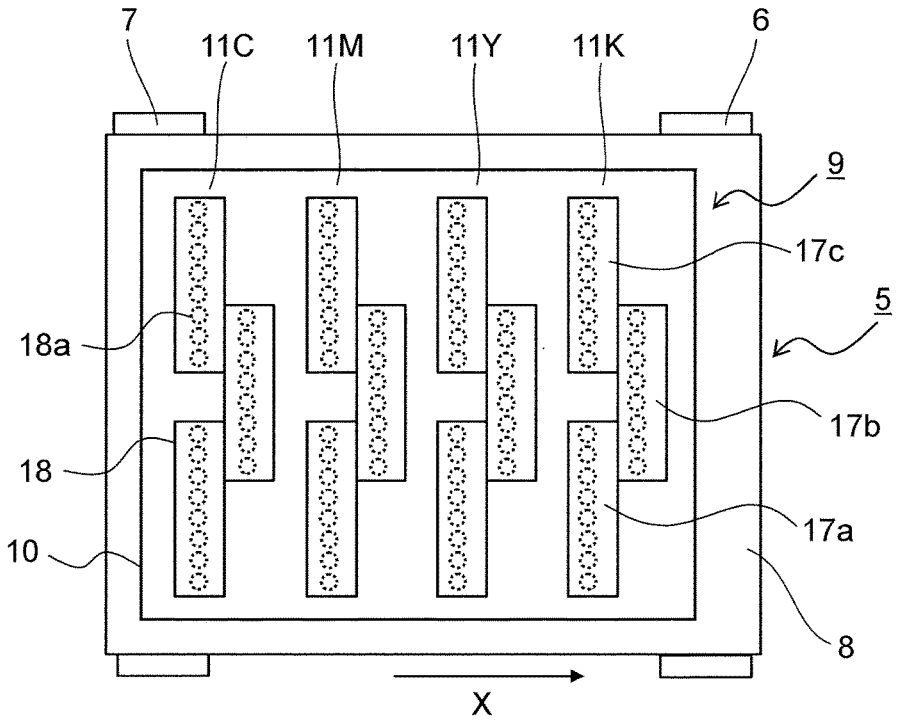
FIG. 2 is a plan view, as seen from above, of a first conveyance unit and a recording portion of the ink-jet recording apparatus shown in FIG. 1.

With reference to the appended drawings, the following describes embodiments of the present disclosure. FIG. 1 is a schematic view showing a structure of an ink-jet recording apparatus 100 provided with recording heads 17*a* to 17*c* of the present disclosure, and FIG. 2 is a view, as seen from above, of a first conveyance unit 5 and a recording portion 9 of the ink-jet recording apparatus 100 shown in FIG. 1. As shown in FIG. 1, in a left side portion of the ink-jet recording apparatus 100, there is provided a paper feed tray 2 that houses a paper sheet S (a recording medium). At one end portion of the paper feed tray 2, there are provided a paper feed roller 3 for conveying (feeding) the paper sheets S thus housed one by one sequentially from an uppermost one thereof to the after-mentioned first conveyance unit 5 and a driven roller 4 that is brought into pressure contact with the paper feed roller 3 and rotates following rotation of the paper feed roller 3.

On a downstream side (a right side in FIG. 1) of the paper feed roller 3 and the driven roller 4 with respect to a paper sheet conveyance direction (an arrow X direction), the first conveyance unit 5 and the recording portion 9 are disposed. The first conveyance unit 5 includes a first driving roller 6, a first driven roller 7, and a first conveyance belt 8 that is wound around the first driving roller 6 and the first driven roller 7. Based on a control signal from a control portion 110 of the ink-jet recording apparatus 100, the first driving roller 6 is driven to rotate in a clockwise direction, and thus the paper sheet S retained on the first conveyance belt 8 is conveyed in the arrow X direction.

The recording portion 9 is provided with a head housing 10 and line heads 11C, 11M, 11Y, and 11K retained in the head housing 10. The line heads 11C to 11K are supported at such a height that a prescribed spacing (for example, 1 mm) is formed with respect to a conveyance surface of the first conveyance belt 8. As shown in FIG. 2, each of the line heads 11C to 11K is composed of a plurality of (herein, three) recording heads 17*a* to 17*c* arranged in a staggered manner along a paper sheet width direction (an up-down direction in FIG. 2) orthogonal to the paper sheet conveyance direction.

Figure 3:
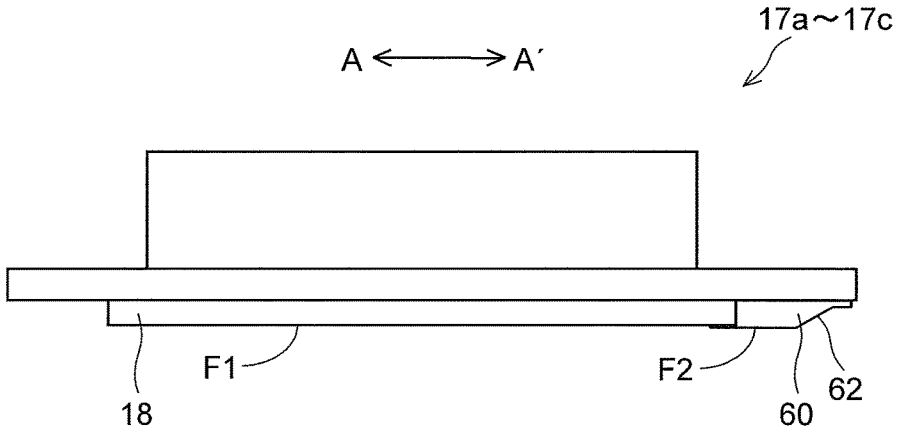
FIG. 3 is a view of a recording head as a component of a line head of the recording portion.
Figure 4:
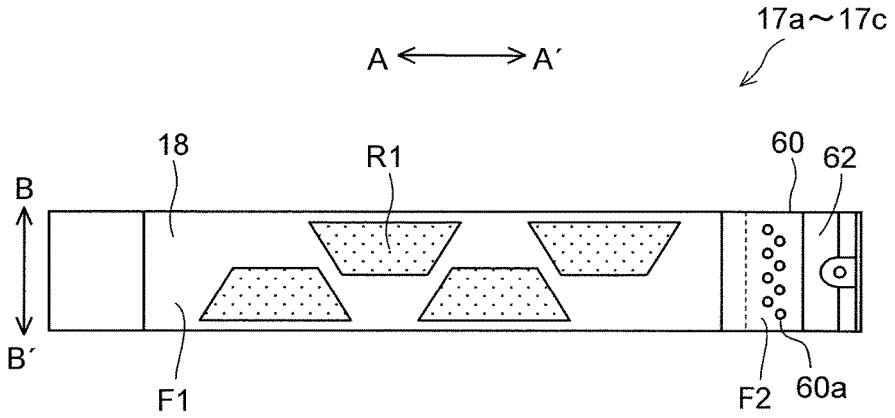
FIG. 4 is a view of a recording head according to a first embodiment of the present disclosure as seen from an ink ejection surface side.
Figure 5:
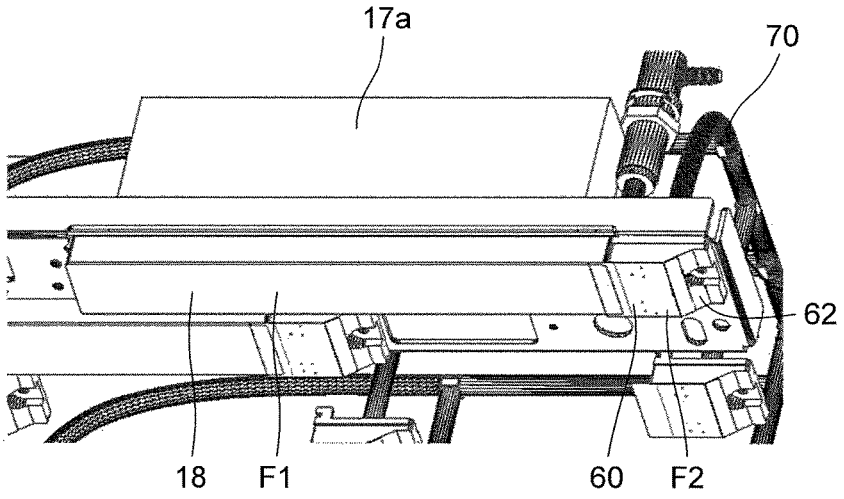
FIG. 5 is a perspective view, as seen from obliquely below, of a periphery of the recording head of the first embodiment.

FIG. 3 is a side view of each of the recording heads 17*a* to 17*c* constituting each of the line heads 11C to 11K of the recording portion 9, FIG. 4 is a plan view of each of the recording heads 17*a* to 17*c* as seen from an ink ejection surface F1 side, and FIG. 5 is a perspective view, as seen from obliquely below, of a periphery of the recording head 17*a*. Since the recording heads 17*a* to 17*c* are the same in shape and configuration, FIG. 3 and FIG. 4 show one recording head representing the recording heads 17*a* to 17*c*. As shown in FIG. 3 and FIG. 4, on an ink ejection surface F1 of a head portion 18 of each of the recording heads 17*a* to 17*c*, there is provided a nozzle region R1 in which a multitude of ink ejection nozzles 18*a* (see FIG. 2) are arranged. At least the ink ejection surface F1 of the head portion 18 is made of, for example, SUS (stainless steel). The ink ejection surface F1 has been treated to have water repellency by applying a fluorine-based or silicone-based water-repellent agent thereon, and herein has a contact angle of 113° with respect to water.

The recording heads 17*a* to 17*c* constituting each of the line heads 11C to 11K are supplied with ink of one of four colors (cyan, magenta, yellow, and black) stored in ink tanks (not shown), respectively, which corresponds to a color of the each of the line heads 110 to 11K.

In accordance with image data received from an external computer in the form of a control signal from the control portion 110 (see FIG. 1), each of the recording heads 17*a* to 17*c* ejects ink through the ink ejection nozzles 18*a* toward the paper sheet S as conveyed while being sucked and retained on the conveyance surface of the first conveyance belt 8. Thus, on the paper sheet S on the first conveyance belt 8, ink images of the four colors of cyan, magenta, yellow and black are superimposed on each other to form a color image. Furthermore, each of the recording heads 17*a* to 17*c* is provided with a cleaning liquid supply member 60 that supplies a cleaning liquid.

Referring back to FIG. 1, a second conveyance unit 12 is disposed on a downstream side (the right side in FIG. 1) of the first conveyance unit 5 with respect to the paper sheet conveyance direction. The second conveyance unit 12 includes a second driving roller 13, a second driven roller 14, and a second conveyance belt 15 that is wound around the second driving roller 13 and the second driven roller 14. The second driving roller 13 is driven to rotate in a clockwise direction, and thus the paper sheet S retained on the second conveyance belt 15 is conveyed in the arrow X direction.

The paper sheet S on which an ink image has been recorded at the recording portion 9 is sent to the second conveyance unit 12, and while the paper sheet S is passing through the second conveyance unit 12, ink that has been ejected on a surface of the paper sheet S is dried. Furthermore, a maintenance unit 19 and a cap unit 90 are disposed below the second conveyance unit 12. The maintenance unit 19 moves to below the recording portion 9 at the time of implementing a wipe-off operation by an after-mentioned wiper 35. Then, a cleaning liquid is supplied through cleaning liquid supply ports 60*a* of each of the recording heads 17*a* to 17*c* and spread by using the wiper 35, while the wiper 35 wipes the cleaning liquid off the ink ejection surface F1 (see FIG. 3), and the cleaning liquid thus wiped off is collected. The cap unit 90 horizontally moves to below the recording portion 9 at the time of capping the ink ejection surface F1 of each of the recording heads 17*a* to 17*c*, and further moves upward so as to be attached to the head portion 18 of the each of the recording heads 17*a* to 17*c*.

Furthermore, on a downstream side of the second conveyance unit 12 with respect to the paper sheet conveyance direction, there is provided a discharge roller pair 16 that discharges the paper sheet S on which an image has been recorded to an outside of the ink-jet recording apparatus 100. On a downstream side of the discharge roller pair 16, there is provided a discharge tray (not shown) on which the paper sheet S that has been discharged to the outside of the ink-jet recording apparatus 100 is loaded.

The maintenance unit 19 is composed of a plurality of the wipers 35 (see FIG.11) that are each movable along the ink ejection surface F1, a substantially rectangular carriage (not shown) on which the plurality of the wipers 35 are secured, and a support frame (not shown) that supports the carriage. The carriage (not shown) is supported so as to be slidable in an arrow AA' direction with respect to the support frame (not shown).

The wiper 35 is an elastic member (a member made of rubber such as, for example, EPDM) for wiping off a cleaning liquid supplied through the cleaning liquid supply ports 60*a* (see FIG. 7) of each of the recording heads 17*a* to 17*c*. The wiper 35 is brought into pressure contact with a portion (herein, an inclined surface 62) of the cleaning liquid supply member 60 on an upstream side in a wiping direction, and as the carriage (not shown) moves, the wiper 35 performs wiping with respect to a cleaning liquid supply surface F2 and the ink ejection surface F1 in a prescribed direction (an arrow A direction).

Figure 6:
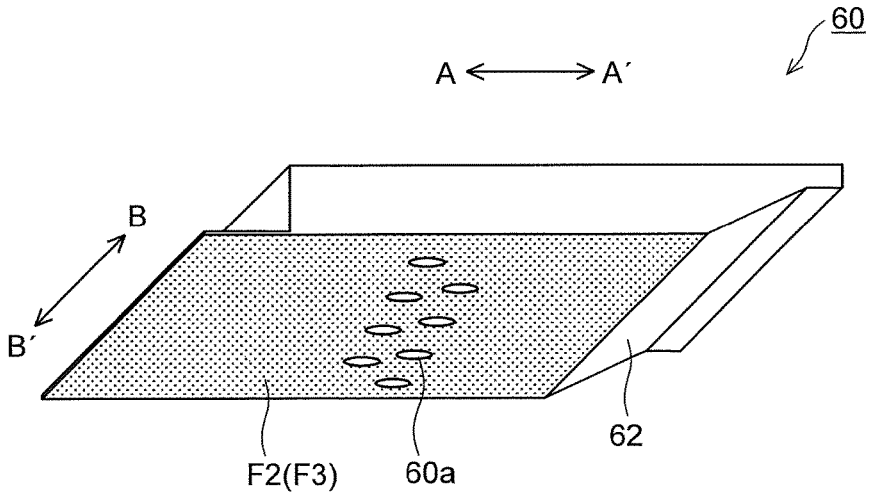
FIG. 6 is a perspective view, as seen from obliquely below, of a cleaning liquid supply member of the recording head of the first embodiment.
Figure 7:
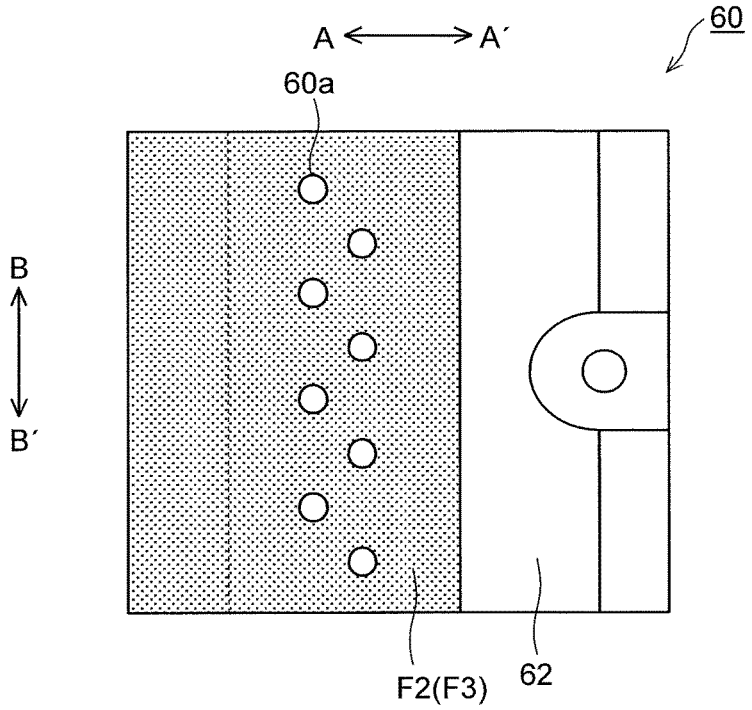
FIG. 7 is a plan view, as seen from below, of the cleaning liquid supply member of the recording head of the first embodiment.

FIG. 6 is a perspective view, as seen from obliquely below, of the cleaning liquid supply member 60 of each of the recording heads 17*a* to 17*c* of the first embodiment, and FIG. 7 is a plan view, as seen from below, of the cleaning liquid supply member 60. The cleaning liquid supply member 60 is made of resin or SUS and disposed adjacently to an upstream side (a right side in FIG. 3) in the wiping direction of the after-mentioned wiper 35 with respect to the head portion 18. The cleaning liquid supply member 60 has the cleaning liquid supply surface F2 on which the cleaning liquid supply ports 60*a* for supplying a cleaning liquid are arranged. The cleaning liquid supply member 60 has been treated to have water repellency lower than that of the ink ejection surface F1, and has a contact angle of 95° or less with respect to water.

Figure 11:
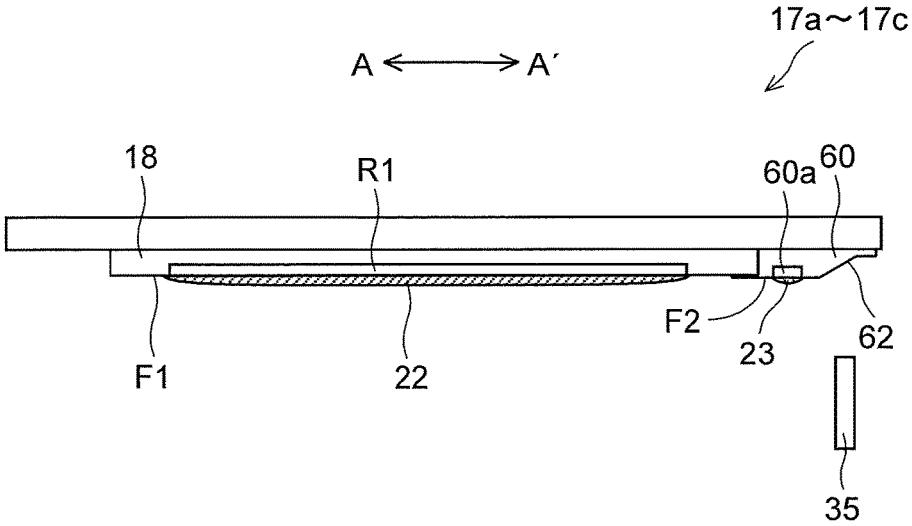
FIG. 11 is a side view showing a state where a wiper is disposed below the recording head.

As shown in FIG. 3, FIG. 5, and FIG. 6, the inclined surface 62 is formed in a portion of the cleaning liquid supply member 60 on an upstream side (the right side in FIG. 3) in the wiping direction with respect to the cleaning liquid supply surface F2. A portion of the cleaning liquid supply surface F2 on a downstream side (a left side in FIG. 3) in the wiping direction is formed in a thin plate shape and disposed so as to overlap an end portion of the ink ejection surface F1 of the head portion 18. For easier understanding, FIG. 5 and after-mentioned FIG. 11 show only a part of the recording heads 17*a* to 17*c*.

As shown in FIG. 6 and FIG. 7, a multitude of the cleaning liquid supply ports 60*a* are disposed in a staggered manner at a prescribed pitch in the wiping direction (the arrow A direction) and in a head width direction (an arrow BB' direction) orthogonal to the wiping direction.

Furthermore, a hydrophilic region F3 (a hatched region in FIG. 6 and FIG. 7) having wettability with respect to water higher than those of the ink ejection surface F1 and any other portion of the cleaning liquid supply member 60 (for example, the inclined surface 62) is formed across an entire region of the cleaning liquid supply surface F2. Examples of a method for forming the hydrophilic region F3 include not applying a water-repellent agent on the cleaning liquid supply surface F2, roughening the cleaning liquid supply surface F2, and applying, on the cleaning liquid supply surface F2, a hydrophilic coating agent in place of a water-repellent agent. Examples of such a hydrophilic coating agent include a titanium oxide-based application agent and a polysilicate-based application agent.

While in FIG. 6 and FIG. 7, a plurality of the individual cleaning liquid supply ports 60*a* are disposed at a prescribed pitch, instead of the individual cleaning liquid supply ports 60*a*, a plurality of nozzle groups each formed of a collection of a plurality of the cleaning liquid supply ports 60*a* may be disposed at a prescribed pitch.

Figure 8:
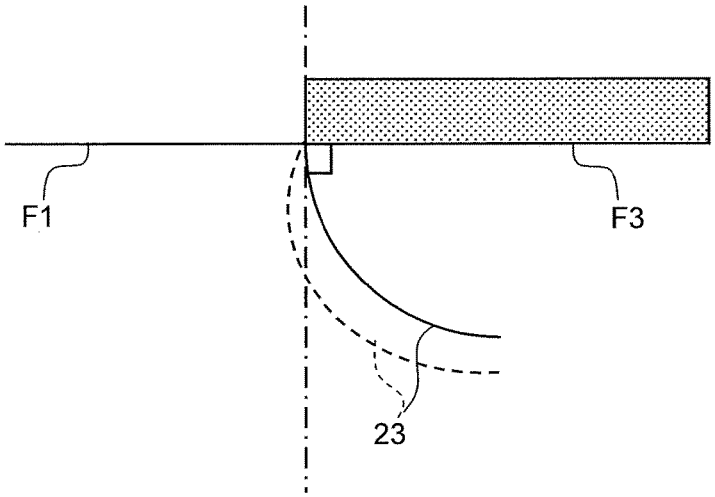
FIG. 8 is a side view showing how a cleaning liquid is retained in a vicinity of a boundary between an ink ejection surface and a hydrophilic region.

FIG. 8 is a side sectional view showing how a cleaning liquid 23 is retained in a vicinity of a boundary between the ink ejection surface F1 and the hydrophilic region F3. In a case where the hydrophilic region F3 has a contact angle of 90° or more with respect to water, under a surface tension, the cleaning liquid 23, which is water-based, protrudes from the hydrophilic region F3 to the ink ejection surface F1 side (shown by a broken line in FIG. 8). Because of this, it becomes likely that the cleaning liquid 23 flows to the ink ejection surface F1 side due to vibration or an impact. In a case of not performing an after-mentioned recovery operation for the recording heads 17*a* to 17*c*, the cleaning liquid 23 flowing to the ink ejection surface F1 side might adversely affect a flying property of ink ejected through the ink ejection nozzles 18*a*.

On the other hand, in a case where the hydrophilic region F3 has a contact angle of less than 90° with respect to water, the cleaning liquid 23, which is water-based, does not protrude from the hydrophilic region F3 to the ink ejection surface F1 side (shown by a solid line in FIG. 8). Thus, preferably, the hydrophilic region F3 has a contact angle of less than 90° with respect to water. Most types of liquids have a surface tension smaller than that of water. Based on this, the hydrophilic region F3 is set to have a contact angle of less than 90° with respect to water, and thus also in a case where the cleaning liquid 23 is based on any other type of liquid than water, there is eliminated a possibility that the cleaning liquid 23 flows from the hydrophilic region F3 to the ink ejection surface F1 side.

Figure 9:
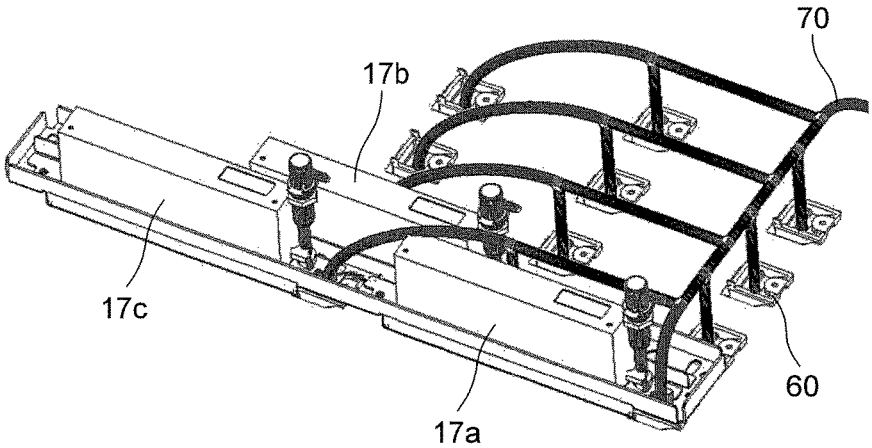
FIG. 9 is a perspective view, as seen from obliquely above, of a periphery of the recording head of the first embodiment.

As shown in FIG. 5 and FIG. 9, a downstream end of a supply channel 70 formed of a tube for passage of the cleaning liquid 23 therethough is connected to the cleaning liquid supply member 60. A cleaning liquid supply mechanism (not shown) is connected to an upstream end of the supply channel 70. The cleaning liquid supply mechanism is composed of a tank (not shown) that stores the cleaning liquid 23 and a pump (not shown) that pumps the cleaning liquid 23 from the tank into the supply channel 70.

The supply channel 70 is formed of one channel at the upstream end thereof and repeatedly branches off toward a downstream side into 12 channels. The 12 channels are connected to the cleaning liquid supply members 60 of the recording heads 17*a* to 17*c*, respectively.

In the ink-jet recording apparatus 100, in order to clean the ink ejection surface Fl of each of the recording heads 17*a* to 17*c*, at a start of printing after a long-term shutdown and during an interim between printing operations, in every one of the recording heads 17*a* to 17*c*, the cleaning liquid 23 is supplied onto the cleaning supply surface F2 through the cleaning liquid supply ports 60*a* (see FIG. 11). Then, the recovery operation for the recording heads 17*a* to 17*c* is implemented in which the ink ejection surface F1 is wiped with the after-mentioned wiper 35, thus making preparation for a subsequent printing operation.

Next, a description is given of the recovery operation for the recording heads 17*a* to 17*c* using the maintenance unit 19 in the ink-jet recording apparatus 100 of this embodiment. The recovery operation for the recording heads 17*a* to 17*c* described below is implemented by controlling, based on a control signal from the control portion 110 (see FIG. 1), operations of the recording heads 17*a* to 17*c*, the maintenance unit 19, and the like.

Figure 10:
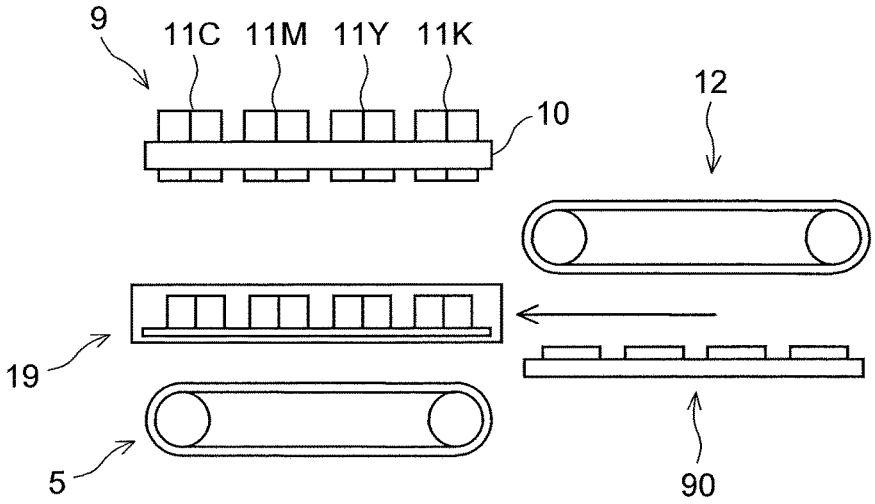
FIG. 10 is a side view showing a state where a maintenance unit is disposed below a recording portion.

In a case of performing the recovery operation for the recording heads 17*a* to 17*c*, first, as shown in FIG. 10, the first conveyance unit 5 positioned below the recording portion 9 is caused to descend. Then, the maintenance unit 19 disposed below the second conveyance unit 12 is caused to horizontally move so as to be disposed between the recording portion 9 and the first conveyance unit 5. In this state, the wiper 35 (see FIG. 11) of the maintenance unit 19 is disposed below a level of the ink ejection surface F1 and the cleaning liquid supply surface F2 of each of the recording heads 17*a* to 17*c* (see FIG. 11).

(Cleaning Liquid Supply Operation)

Prior to a wiping operation (an after-mentioned wipe-off operation), as shown in FIG. 11, based on a control signal from the control portion 110 (see FIG. 1), the cleaning liquid 23 is supplied to each of the recording heads 17*a* to 17*c*. The cleaning liquid 23 thus supplied is ejected by a prescribed amount onto the cleaning liquid supply surface F2 through the cleaning liquid supply ports 60*a* (see FIG. 7).

Figure 12:
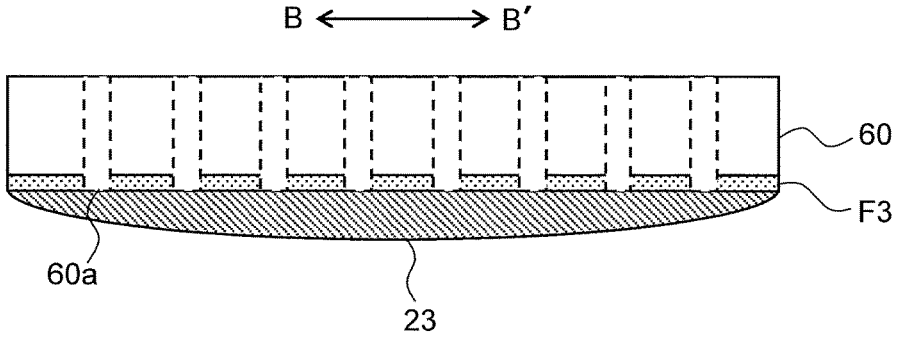
FIG. 12 is a side sectional view showing how the cleaning liquid is retained on a cleaning liquid supply surface as seen from a downstream side in a wipe-off direction of the wiper.

Herein, as shown in FIG. 7, the hydrophilic region F3 is formed across the entire region of the cleaning liquid supply surface F2. Because of this, as shown in FIG. 12, the cleaning liquid 23 is retained in a state of being spread over an entire region of the hydrophilic region F3 (the cleaning liquid supply surface F2) in a width direction thereof (the arrow BB' direction).

(Ink Extrusion Operation)

Furthermore, prior to the wiping operation (the after-mentioned wipe-off operation), as shown in FIG. 11, ink 22 is supplied to each of the recording heads 17*a* to 17*c* by the control portion 110 (see FIG. 1). The ink 22 thus supplied is forcibly extruded (purged) through the ink ejection nozzles 18a. As a result of this purge operation, thickened ink, foreign substances, and air bubbles in the ink ejection nozzles 18*a* are discharged through the ink ejection nozzles 18a. At this time, the purged ink 22 is extruded onto the ink ejection surface F1 along a shape of the nozzle region R1 in which the ink ejection nozzles 18*a* are present. In the figure, the ink (the purged ink) 22 is hatched for easier understanding.

(Wipe-Off Operation)

Figure 13:
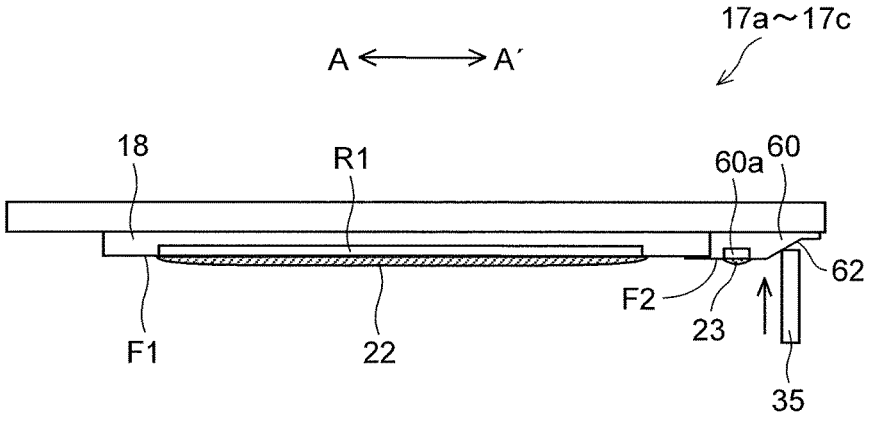
FIG. 13 is a side view showing a state where the wiper is caused to ascend from the state shown in FIG. 11 so as to be brought into pressure contact with the cleaning liquid supply member.

As shown in FIG. 13, based on a control signal from the control portion 110, the wiper 35 is caused to ascend so as to be brought into contact under a prescribed pressure with the inclined surface 62 of the cleaning liquid supply member 60 of each of the recording heads 17*a* to 17*c*.

Figure 14:
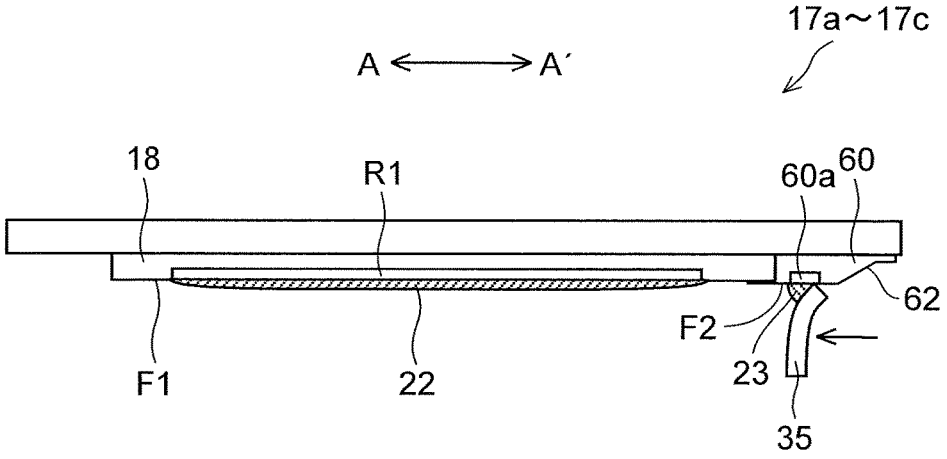
FIG. 14 is a side view showing a state where the wiper, while being in pressure contact with the cleaning liquid supply member, is caused to move in an arrow A direction from the state shown in FIG. 13.

From a state where a tip end of the wiper 35 is in pressure contact with the inclined surface 62 of the cleaning liquid supply member 60, the wiper 35 is caused to move in a direction toward the nozzle region R1 (the arrow A direction) along the cleaning liquid supply surface F2. Thus, the wiper 35 wipes off the cleaning liquid 23 as shown in FIG. 14 and thereafter moves in the direction toward the nozzle region R1 while retaining the cleaning liquid 23.

Figure 15:
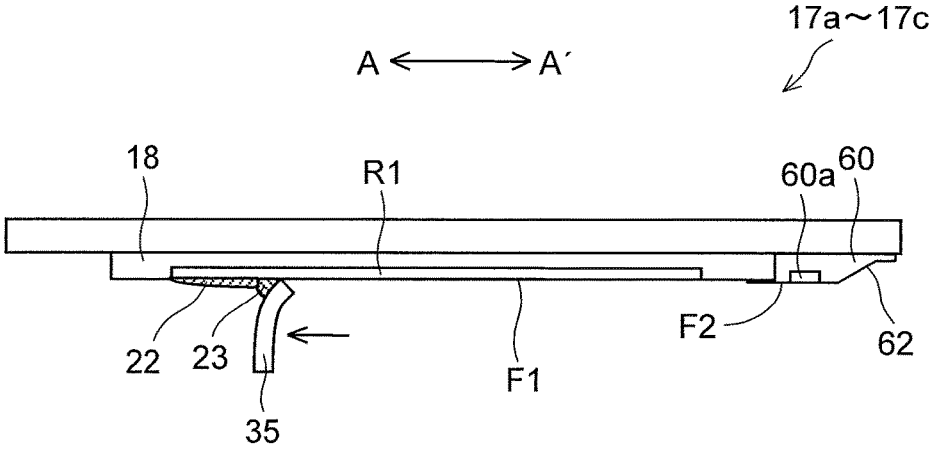
FIG. 15 is a side view showing a state where the wiper is caused to move further in the arrow A direction from the state shown in FIG. 14.

Then, as shown in FIG. 15, while maintaining a state of retaining the cleaning liquid 23 and the purged ink 22, the wiper 35 moves in a left direction (the arrow A direction) along the ink ejection surface Fl. At this time, the cleaning liquid 23 and the purged ink 22 dissolves ink droplets (waste ink) that have adhered to and been solidified on the ink ejection surface F1, and the ink droplets (waste ink) thus dissolved are wiped off by the wiper 35. Then, the wiper 35 further moves in the left direction (the arrow A direction) and, upon reaching an end portion on an opposite side to the cleaning liquid supply member 60 with respect to the nozzle region R1, is stopped from moving in the left direction. The cleaning liquid 23 and the waste ink thus wiped off by the wiper 35 are collected into a cleaning liquid collection tray (not shown) that is provided in the maintenance unit 19.

(Separation Operation)

Figure 16:
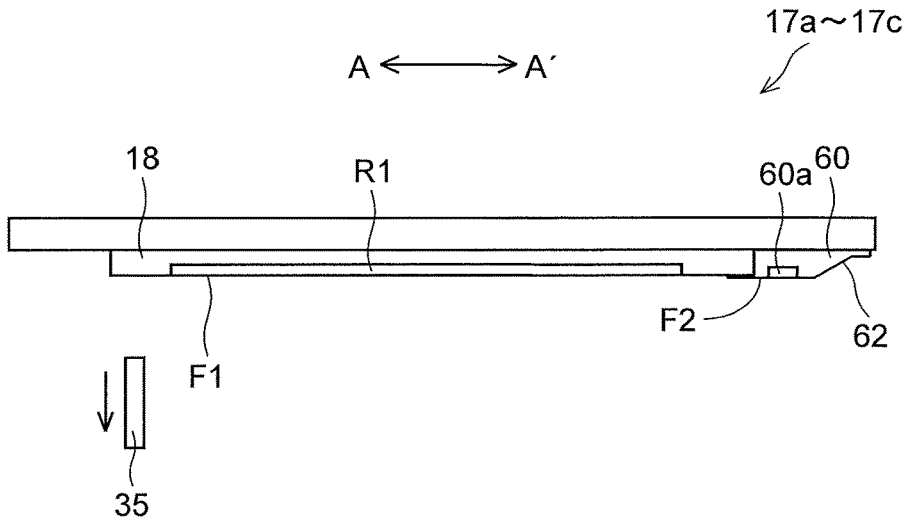
FIG. 16 is a side view showing a state where, after moving further in the arrow A direction from the state shown in FIG. 15, the wiper is caused to descend so as to be separated from the ink ejection surface.

After implementation of the wipe-off operation, as shown in FIG. 16, the wiper 35 is caused to descend so as to be separated from the ink ejection surface Fl.

Finally, the maintenance unit 19, which is disposed between the recording portion 9 and the first conveyance unit 5, is caused to horizontally move so as to be disposed below the second conveyance unit 12, and the first conveyance unit 5 is caused to ascend to a prescribed position. In this manner, the recovery operation for the recording heads 17*a* to 17*c* is completed.

In this embodiment, as described above, on an upstream side in the wiping direction (the arrow A direction) with respect to the nozzle region R1, the plurality of cleaning liquid supply ports 60*a* for supplying the cleaning liquid 23 are provided. With this configuration, after the cleaning liquid 23 is supplied through the cleaning liquid supply ports 60a, the wiper 35 is caused to move from an upstream side beyond the cleaning liquid supply ports 60*a* in the wiping direction along the ink ejection surface F1, and thus the ink ejection surface F1 can be wiped by using the wiper 35, while the wiper 35 retains the cleaning liquid 23. Consequently, the ink ejection surface F1 can be cleaned.

Furthermore, the hydrophilic region F3 is formed over the entire region of the cleaning liquid supply surface F2, and the cleaning liquid 23 supplied through the cleaning liquid supply ports 60*a* is retained in a state of being spread over the hydrophilic region F3. With this configuration, the cleaning liquid 23 is uniformly supplied over the entire region of the cleaning liquid supply surface F2 in the width direction thereof (the arrow BB' direction), and thus the cleaning liquid 23 can be brought into contact with an entire region of the wiper 35 in a width direction thereof. Thus, an entire region of the ink ejection surface F1, which is continuous with the cleaning liquid supply surface F2, in a width direction thereof can be easily and uniformly cleaned, so that image quality can be maintained for a long period of time by suppressing occurrence of deterioration in linearity of ink ejection (flight deflection), failure of ink ejection, or the like. Furthermore, it is also possible to suppress peeling of a water-repellent film on the ink ejection surface F1 and breakage of the wiper 35 due to friction between the ink ejection surface F1 and the wiper 35.

Furthermore, the cleaning liquid 23 is retained so as to be spread along the hydrophilic region F3, and thus it is possible to suppress droplets of the cleaning liquid 23 being united with each other to form a larger droplet. Consequently, it is possible to suppress dropping of the cleaning liquid 23 from the cleaning liquid supply surface F2 and thus to reduce loss of the cleaning liquid 23.

As mentioned earlier, the cleaning liquid supply member 60 has been treated to have water repellency lower than that of the ink ejection surface F1, and thus a hydrophilic property of the cleaning liquid supply surface F2 is somewhat higher than that of the ink ejection surface F1. In this embodiment, the hydrophilic region F3 having a hydrophilic property even higher than that of the cleaning liquid supply surface F2 is formed by a hydrophilic treatment with respect to the cleaning liquid supply surface F2, such as not applying a water-repellent agent on the cleaning liquid supply surface F2, roughening the cleaning liquid supply surface F2, or applying a hydrophilic coating agent on the cleaning liquid supply surface F2. That is, there is established a relationship $\theta 1>\theta 2>\theta 3$ where $\theta 1$ represents a contact angle of the ink ejection surface F1 with respect to water, $\theta 2$ represents a contact angle of the cleaning liquid supply surface F2 (the cleaning liquid supply member 60) with respect to water, and 83 represents a contact angle of the hydrophilic region F3 with respect to water.

Figure 17:
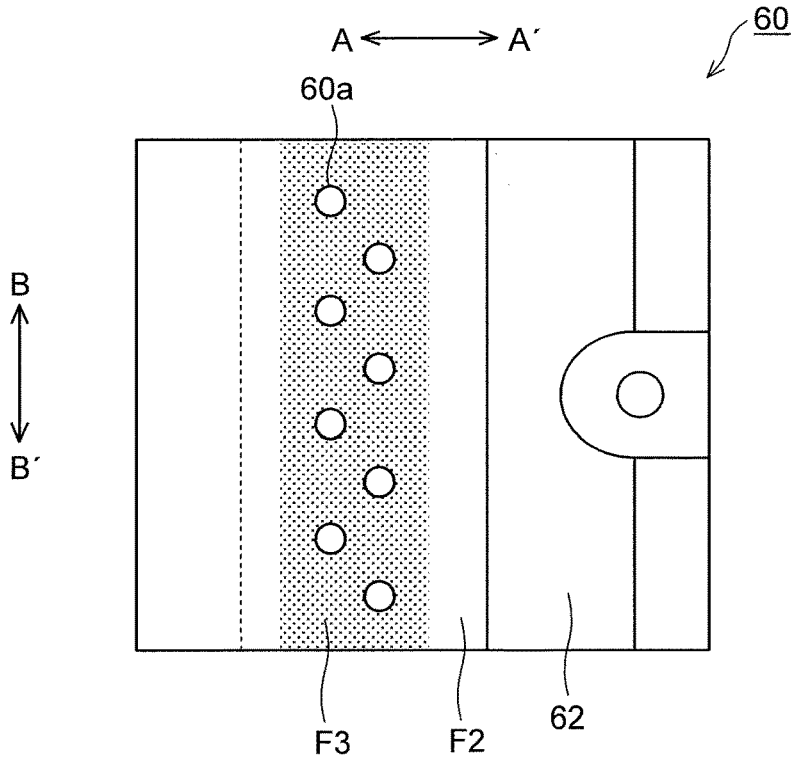
FIG. 17 is a plan view, as seen from below, of a cleaning liquid supply member of a recording head according to a second embodiment of the present disclosure.

FIG. 17 is a view, as seen from below, of a cleaning liquid supply member 60 of each of recording heads 17*a* to 17*c* according to a second embodiment of the present disclosure. In this embodiment, as shown in FIG. 17, in a moving direction of the wiper 35 (an arrow AA' direction), a hydrophilic region F3 is formed in a region of a cleaning liquid supply surface F2, which includes cleaning liquid supply ports 60*a*, so as to form a belt shape continuous across an entire region in a width direction thereof. Other portions of the cleaning liquid supply member 60 are configured similarly to those in the first embodiment shown in FIG. 6 and FIG. 7.

According to a configuration of this embodiment, the hydrophilic region F3 is formed only in a part of the cleaning liquid supply surface F2, and thus processing of the cleaning liquid supply member 60 is facilitated. Furthermore, the cleaning liquid 23 is retained intensively in the moving direction of the wiper 35 (the arrow AA' direction), and thus even with a reduced supply amount of the cleaning liquid 23, it becomes likely that the cleaning liquid 23 is spread over an entire region of the cleaning liquid supply surface F2 in a width direction thereof. Moreover, a part of the cleaning liquid supply surface F2 is interposed between the hydrophilic region F3 and the ink ejection surface F1, and thus the cleaning liquid 23 can be more reliably prevented from leaking from the hydrophilic region F3 to the ink ejection surface F1.

Figure 18:
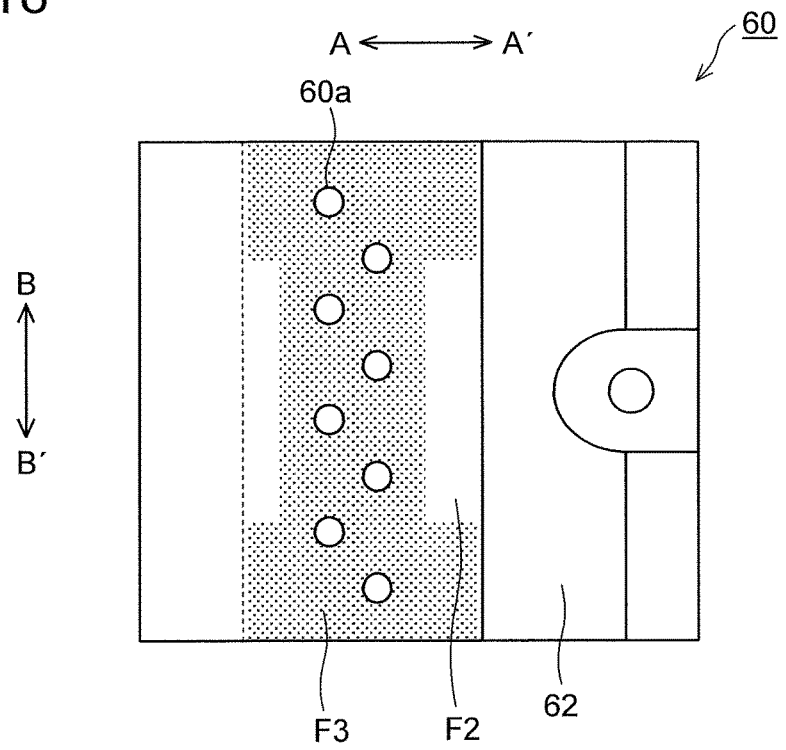
FIG. 18 is a plan view, as seen from below, of a cleaning liquid supply member of a recording head according to a third embodiment of the present disclosure.

FIG. 18 is a view, as seen from below, of a cleaning liquid supply member 60 of each of recording heads 17*a* to 17*c* according to a third embodiment of the present disclosure. In this embodiment, as shown in FIG. 18, in each of both end portions of a cleaning liquid supply surface F2 in a width direction thereof (an arrow BB' direction), a hydrophilic region F3 is formed so as to be elongated in the moving direction of the wiper 35 (an arrow AA' direction). Other portions of the cleaning liquid supply member 60 are configured similarly to those in the first and second embodiments.

In the first and second embodiments, droplets of the cleaning liquid 23 supplied through the cleaning liquid supply ports 60*a* are united with each other to form a larger droplet, gathering at a center portion of the cleaning liquid supply surface F2 in the width direction thereof as shown in FIG. 12. According to a configuration of this embodiment, in each of the both end portions of the cleaning liquid supply surface F2 in the width direction thereof, the hydrophilic region F3 has an increased area, and thus it becomes likely that the cleaning liquid 23 is spread also to the both end portions of the cleaning liquid supply surface F2 in the width direction thereof. Thus, compared with the first and second embodiments, the cleaning liquid 23 can be more uniformly supplied across the entire region of the cleaning liquid supply surface F2 in the width direction thereof.

Figure 19:
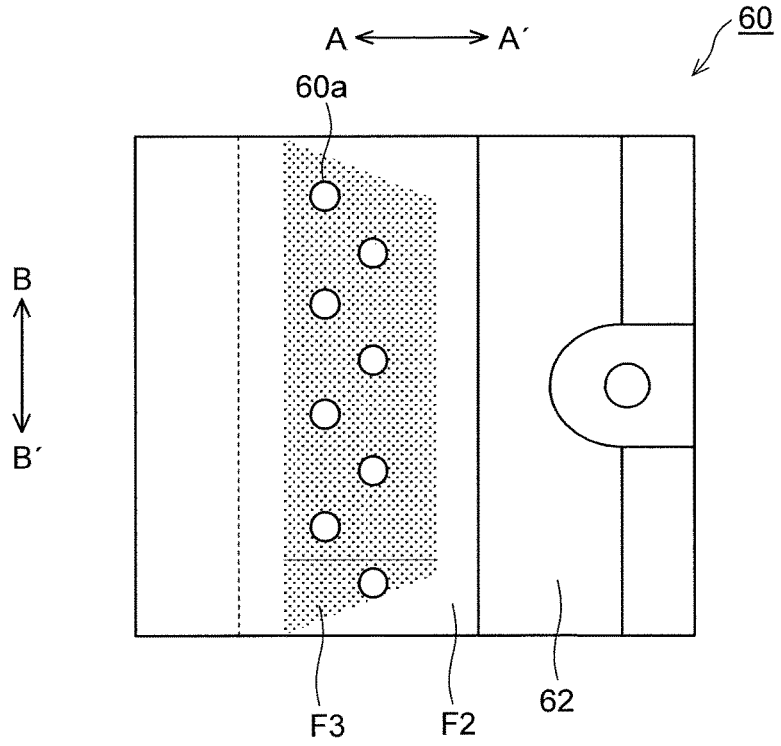
FIG. 19 is a plan view, as seen from below, of a cleaning liquid supply member of a recording head according to a fourth embodiment of the present disclosure.

FIG. 19 is a view, as seen from below, of a cleaning liquid supply member 60 of each of recording heads 17*a* to 17*c* according to a fourth embodiment of the present disclosure. In this embodiment, as shown in FIG. 19, a hydrophilic region F3 is formed in such a trapezoidal shape as to be widened from an upstream side toward a downstream side in the wiping direction (an arrow A direction). Other portions of the cleaning liquid supply member 60 are configured similarly to those in the first to third embodiments.

According to a configuration of this embodiment, immediately prior to a wiping operation, the cleaning liquid 23 supplied through cleaning liquid supply ports 60*a* is retained on an upstream side (a right side) in the hydrophilic region F3 and not spread to both end portions of a cleaning liquid supply surface F2 in a width direction thereof. Then, through the wiping operation by the wiper 35, the cleaning liquid 23 is spread gradually from the upstream side toward a downstream side along the shape of the hydrophilic region F3. With this configuration, it is possible to suppress a phenomenon in which, immediately after a start of a wiping operation, the cleaning liquid 23 is extruded by the wiper 35 to an outer side of the cleaning liquid supply surface F2 in the width direction thereof. Thus, the cleaning liquid 23 can be used for cleaning of the ink ejection surface F1 without being wasted.

Figure 20:
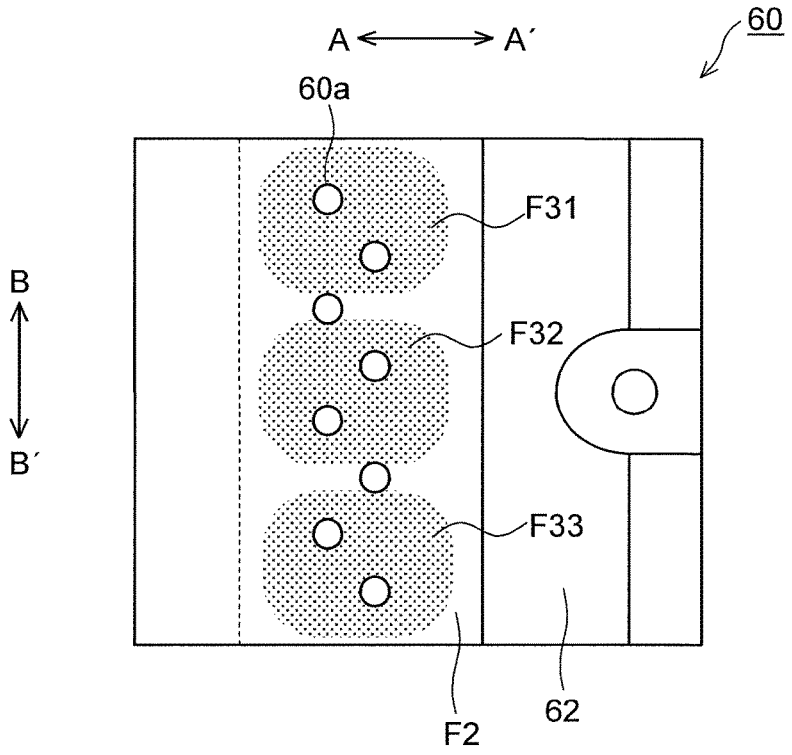
FIG. 20 is a plan view, as seen from below, of a cleaning liquid supply member of a recording head according to a fifth embodiment of the present disclosure.
Figure 21:
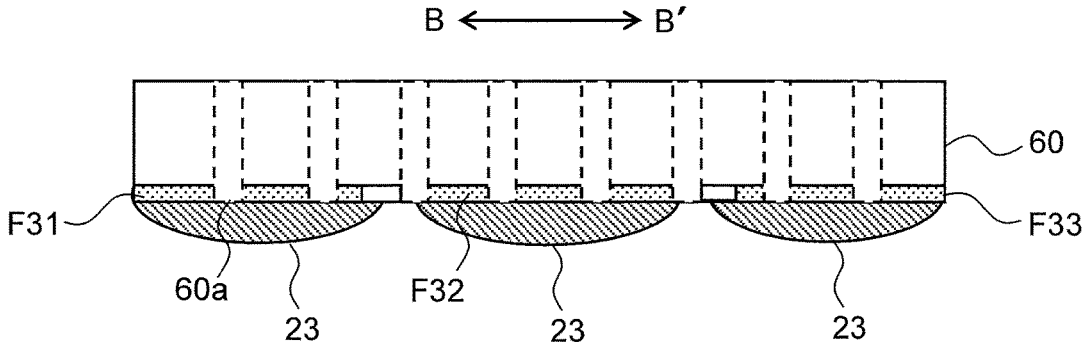
FIG. 21 is a side sectional view showing how, in the recording head of the fifth embodiment, a cleaning liquid is retained on a cleaning liquid supply surface as seen from a downstream side in a wipe-off direction of a wiper.

FIG. 20 is a view, as seen from below, of a cleaning liquid supply member 60 of each of recording heads 17*a* to 17*c* according to a fifth embodiment of the present disclosure, and FIG. 21 is a view showing how, in each of the recording heads 17*a* to 17*c* of the fifth embodiment, the cleaning liquid 23 is retained on a cleaning liquid supply surface F2 as seen from a downstream side in a wipe-off direction of the wiper 35. In this embodiment, as shown in FIG. 20, three individual hydrophilic regions F31, F32, and F33 are formed along a width direction of the cleaning liquid supply surface F2 (an arrow BB' direction). Other portions of the cleaning liquid supply member 60 are configured similarly to those in the first to fourth embodiments.

According to a configuration of this embodiment, the three hydrophilic regions F31 to F33 are individually formed in the width direction of the cleaning liquid supply surface F2, and thus, as shown in FIG. 21, the cleaning liquid 23 supplied through cleaning liquid supply ports 60*a* is retained in such a manner as to be divided into parts, which are retained in the hydrophilic regions F31 to F33, respectively. With this configuration, the cleaning liquid 23 is prevented from being retained in such a manner as to be concentrated toward a center in the width direction as shown in FIG. 12, and thus the cleaning liquid 23 can be supplied substantially uniformly over an entire region in the width direction.

Figure 22:
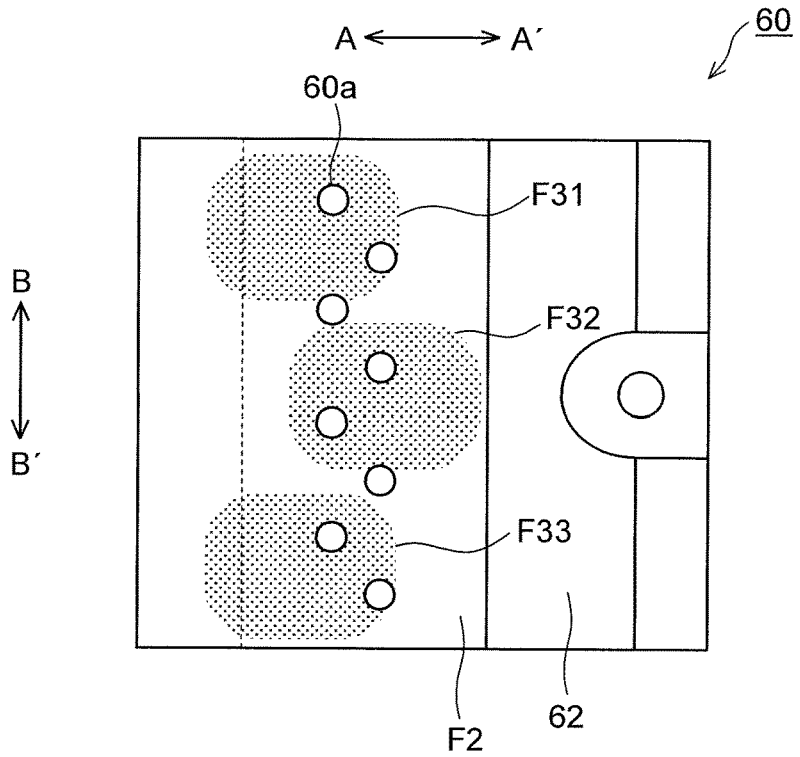
FIG. 22 is a plan view, as seen from below, of a cleaning liquid supply member of a recording head according to a sixth embodiment of the present disclosure.

FIG. 22 is a view, as seen from below, of a cleaning liquid supply member 60 of each of recording heads 17*a* to 17*c* according to a sixth embodiment of the present disclosure. In this embodiment, similarly to the fifth embodiment, three individual hydrophilic regions F31, F32, and F33 are formed along a width direction of a cleaning liquid supply surface F2 (an arrow BB' direction). Furthermore, the hydrophilic region F32 in a center portion in the width direction is formed so as to be positionally shifted to an upstream side in the wiping direction (a right side in FIG. 22), and the hydrophilic regions F31 and F33 in both end portions in the width direction are formed so as to be positionally shifted to a downstream side in the wiping direction (a left side in FIG. 22). Other portions of the cleaning liquid supply member 60 are configured similarly to those in the first to fifth embodiments.

According to a configuration of this embodiment, similarly to the fifth embodiment, the cleaning liquid 23 is retained in such a manner as to be divided into parts, which are retained in the hydrophilic region F31 to F 33, respectively, and thus the cleaning liquid 23 can be supplied substantially uniformly over an entire region in the width direction. Furthermore, the hydrophilic region F32 in the center portion in the width direction is positionally shifted to the upstream side in the wiping direction, and the hydrophilic regions F31 and F33 in the both end portions in the width direction are positionally shifted to the downstream side in the width direction, and thus, through a wiping operation by the wiper 35, the cleaning liquid 23 is spread gradually from the hydrophilic region F32 toward the hydrophilic regions F31 and F33. With this configuration, similarly to the fourth embodiment, it is possible to suppress a phenomenon in which, immediately after a start of a wiping operation, the cleaning liquid 23 is extruded by the wiper 35 to an outer side of the cleaning liquid supply surface F2 in the width direction thereof. Thus, the cleaning liquid 23 can be used for cleaning of the ink ejection surface F1 without being wasted.

Figure 23:
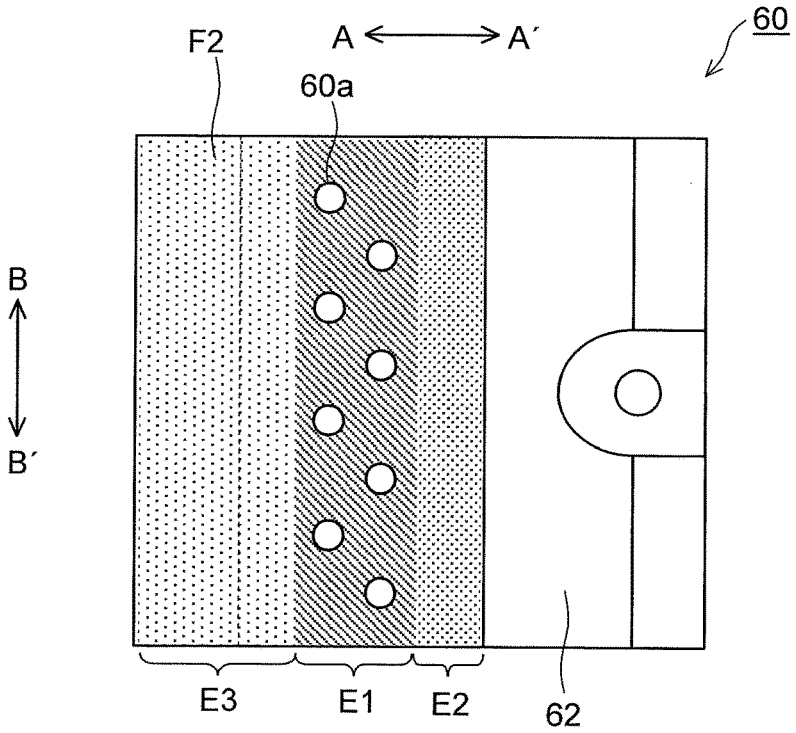
FIG. 23 is a plan view, as seen from below, of a cleaning liquid supply member of a recording head according to a seventh embodiment of the present disclosure.

FIG. 23 is a view, as seen from below, of a cleaning liquid supply member 60 of each of recording heads 17*a* to 17*c* according to a seventh embodiment of the present disclosure. In this embodiment, a cleaning liquid supply surface F2 is partitioned along the wiping direction (an arrow A direction) into a first region E1 including cleaning liquid supply ports 60a, a second region E2 adjacent to the first region E1 on an upstream side with respect to the wiping direction, and a third region E3 adjacent to the first region E1 on a downstream side with respect to the wiping direction.

The first region E1 has a hydrophilic property higher than those of the second and third regions E1 and E3. Furthermore, the second region E2 has a hydrophilic property equal to or lower than that of the third region E3. Preferably, the first region E1 has a contact angle of less than 90° with respect to water. Examples of a method for setting the first region E1 to have a hydrophilic property higher than those of the second and third regions E2 and E3 include applying a water-repellent agent on the second and third regions E2 and E3 while not applying it on the first region E1, roughing a surface of the first region E1, and applying a hydrophilic coating agent on the first region E1. Examples of such a hydrophilic coating agent include a titanium oxide-based application agent and a polysilicate-based application agent. Furthermore, examples of a method for setting the second region E2 to have a hydrophilic property lower than that of the third region E3 include applying water-repellent agents different in degree of water repellency on the second region E2 and the second region E3, respectively.

The first region E1 including the cleaning liquid supply ports 60*a* is set to have a hydrophilic property higher than those of the second and third regions E2 and E3, and thus the cleaning liquid 23 supplied through the cleaning liquid supply ports 60*a* onto the first region E1 is retained in a state of being spread over an entire region of the first region E1 in a width direction thereof. While in FIG. 23, the plurality of individual cleaning liquid supply ports 60*a* are disposed at a prescribed pitch, instead of the individual cleaning supply ports 60*a*, a plurality of supply port groups each formed of a collection of a plurality of the cleaning liquid supply ports 60*a* may be disposed at a prescribed pitch.

Figure 24:
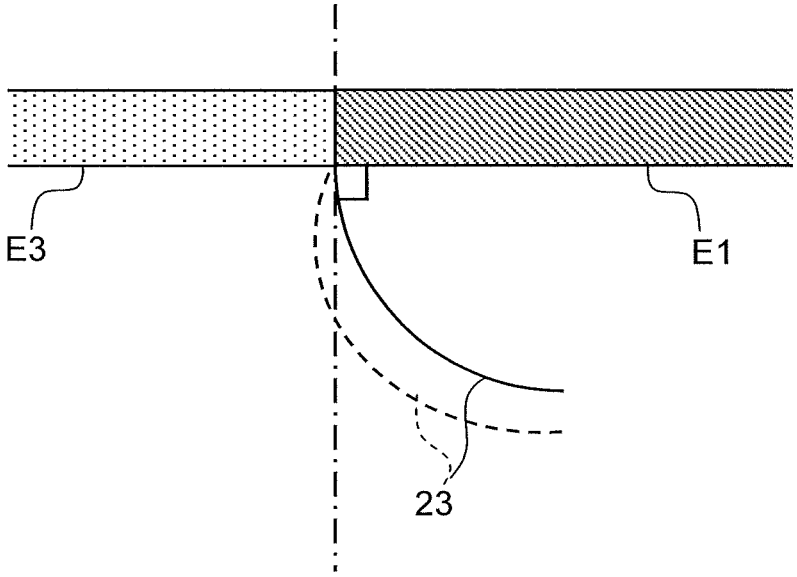
FIG. 24 is a side view showing how, in the recording head of the seventh embodiment, a cleaning liquid is retained in a vicinity of a boundary between a first region and a third region of a cleaning liquid supply surface.

FIG. 24 is a side sectional view showing how, in each of the recording heads 17*a* to 17*c* of the seventh embodiment, the cleaning liquid 23 is retained in a vicinity of a boundary between the first region E1 and the third region E3. In a case where the first region E1 has a contact angle of 90° or more with respect to water, under a surface tension, the cleaning liquid 23, which is water-based, protrudes from the first region E1 to a third region E3 side (shown by a broken line in FIG. 24). Because of this, it becomes likely that the cleaning liquid 23 flows to the third region E3 side (the ink ejection surface F1 side) due to vibration or an impact. In a case of not performing the above-mentioned recovery operation for the recording heads 17*a* to 17*c*, the cleaning liquid 23 flowing to the ink ejection surface F1 side might adversely affect a flying property of ink ejected through the ink ejection nozzles 18*a*.

On the other hand, in a case where the first region E1 has a contact angle of less than 90° with respect to water, the cleaning liquid 23, which is water-based, does not protrude from the first region E1 to the third region E3 side (shown by a solid line in FIG. 24). Thus, preferably, the first region E1 has a contact angle of less than 90° with respect to water. Most types of liquids have a surface tension smaller than that of water. Based on this, the first region E1 is set to have a contact angle of less than 90 with respect to water, and thus also in a case where the cleaning liquid 23 is based on any other type of liquid than water, there is eliminated a possibility that the cleaning liquid 23 flows from a first region E1 side to the third region E3 side. Though not shown herein, the same description applies also to a retaining state of the cleaning liquid 23 at a boundary between the first region E1 and the second region E2.

According to this embodiment, the cleaning liquid supply surface F2 is partitioned into the first region E1 including the cleaning liquid supply ports 60*a*, the second region E2 adjacent to the first region E1 on the upstream side, and the third region E3 adjacent to the first region E1 on the downstream side. Thus, as shown in FIG. 12, the cleaning liquid 23 supplied through the cleaning liquid supply ports 60*a* is retained in a state of being spread over the first region E1 in a width direction thereof (the arrow BB' direction). With this configuration, the cleaning liquid 23 is uniformly supplied over an entire region of the cleaning liquid supply surface F2 in a width direction thereof, and thus the cleaning liquid 23 can be brought into contact with the entire region of the wiper 35 in the width direction thereof. Thus, the entire region of the ink ejection surface F1, which is continuous with the cleaning liquid supply surface F2, in the width direction thereof can be easily and uniformly cleaned, so that image quality can be maintained for a long period of time by suppressing occurrence of deterioration in linearity of ink ejection (flight deflection), failure of ink ejection, or the like. Furthermore, it is also possible to suppress peeling of the water-repellent film on the ink ejection surface F1 and breakage of the wiper 35 due to friction between the ink ejection surface F1 and the wiper 35.

Furthermore, the cleaning liquid 23 is retained so as to be spread along the entire region of the first region E1, which is highest in hydrophilic property, and thus it is possible to suppress droplets of the cleaning liquid 23 being united with each other to form a larger droplet. Consequently, it is possible to suppress dropping of the cleaning liquid 23 from the cleaning liquid supply surface F2 and thus to reduce loss of the cleaning liquid 23.

A further detailed description is given of a relationship between a hydrophilic property of the first region E1 and respective hydrophilic properties of the second region E2 and the third region E3. Table 1 shows examples of a pattern of respective contact angles of the first to third regions E1 to E3 with respect to water.

TABLE 1

| | Contact Angle with Respect to Water [°] | | |
|---|---|---|---|
| | First Region | Second Region | Third Region |
| Example 1 | 20 | 110 | 110 |
| Example 2 | 40 | 120 | 120 |
| Example 3 | 40 | 80 | 90 |
| Example 4 | 60 | 100 | 100 |

A contact angle of the first region E1 in Example 1 is 20° and that in Example 2 is 40°, which are small, so that it is likely that a cleaning liquid is spread entirely over the first region E1. Furthermore, a difference in contact angle between the first region E1 and the second region E2 or the third region E3 in Example 1 is 90° and that in Example 2 is 80°, which are large, so that spreading of the cleaning liquid to the second region E2 and the third region E3 is also suppressed.

On the other hand, contact angles of the second region E2 and the third region E3 in Example 3 are 80° and 90°, respectively, which are small, so that it becomes likely that a cleaning liquid is spread also to the second region E2 and the third region E3. Furthermore, a contact angle of the first region E1 in Example 4 is 60°, which is somewhat large, so that it becomes unlikely that a cleaning liquid is spread entirely over the first region E1.

Based on the above, the first region E1 is set to have a contact angle of less than 90° with respect to water. Preferably, the first region E1 has a contact angle of 50° or less with respect to water. Furthermore, the second region E2 and the third region E3 are each set to have a contact angle of 90° or more with respect to water. Preferably, a difference in contact angle between the second region E2 or the third region E3 and the first region E1 is 80° or more.

Other than the above, the present disclosure is not limited to the foregoing embodiments, and various modifications thereto are possible without departing from the spirit of the present disclosure. For example, while the foregoing embodiments have described an example in which the cleaning liquid supply member 60 having the cleaning liquid supply ports 60 open therein is provided separately from the head portion 18, the present disclosure is not limited thereto. A configuration may also be adopted in which the cleaning liquid supply member 60 is nor provided, and the cleaning liquid supply ports 60*a* are provided in the head portion 18. Furthermore, the cleaning liquid supply ports 60*a* may be set to be disposed in any arrangement and at any pitch.

Furthermore, while in the foregoing fifth and sixth embodiments, the three hydrophilic regions F31 to F33 are formed along the width direction of the cleaning liquid supply surface F2, a configuration may also be adopted in which two or four or more hydrophilic regions are individually formed.

Furthermore, while the foregoing embodiments have described an example in which a cleaning liquid supply operation is implemented prior to a wipe-off operation, the cleaning liquid supply operation may be implemented concurrently with the wipe-off operation as long as the cleaning liquid supply operation precedes an entry of the wiper 35 into the hydrophilic region F3 (the first region E1 in the seventh embodiment).

What is claimed is:

1. A recording head, comprising:

an ink ejection surface that includes a nozzle region in which a plurality of ink ejection nozzles for ejecting ink onto a recording medium are open; and a cleaning liquid supply surface that is provided, with respect to the nozzle region, on an upstream side in a wiping direction in which a wiper wipes the ink ejection surface, and through which a plurality of cleaning liquid supply ports for supplying a cleaning liquid are open, wherein on the cleaning liquid supply surface, at least in a region including the cleaning liquid supply ports, a hydrophilic region having wettability with respect to water higher than that of the ink ejection surface is formed substantially evenly across an entire region in a width direction thereof orthogonal to the wiping direction, and an inclined surface that is inclined downward in the wiping direction and with which the wiper is brought into pressed contact when the ink ejection surface starts to be wiped is formed in a portion on an upstream side in the wiping direction with respect to the cleaning liquid supply ports so as to be continuous with the cleaning liquid supply surface.

2. The recording head according to claim 1, wherein in the wiping direction, the hydrophilic region is formed in the region of the cleaning liquid supply surface, which includes the cleaning liquid supply ports, so as to form a belt shape continuous across the entire region in the width direction.

3. The recording head according to claim 2, wherein the hydrophilic region is formed at a prescribed distance from the ink ejection surface.

4. The recording head according to claim 2, wherein in each of both end portions of the cleaning liquid supply surface in a width direction thereof, the hydrophilic region is formed so as to be elongated in the wiping direction.

5. The recording head according to claim 2, wherein the hydrophilic region is formed in such a trapezoidal shape as to be widened from an upstream side toward a downstream side in the wiping direction.

6. The recording head according to claim 1, wherein the hydrophilic region comprises a plurality of individual hydrophilic regions, and on the cleaning liquid supply surface, the plurality of individual hydrophilic regions are formed along a width direction of the cleaning liquid supply surface.

7. The recording head according to claim 6, wherein one of the plurality of individual hydrophilic regions which is positioned in a center portion of the cleaning liquid supply surface in the width direction thereof is formed so as to be positionally shifted to an upstream side in the wiping direction, and others of the plurality of individual hydrophilic regions which are positioned in both end portions of the cleaning liquid supply surface in the width direction thereof are formed so as to be positionally shifted to a downstream side in the wiping direction.

8. The recording head according to claim 1, wherein the hydrophilic region has a contact angle of less than 90° with respect to water.

9. The recording head according to claim 8, wherein the cleaning liquid supply surface is formed in a cleaning liquid supply member that is disposed adjacently to the ink ejection surface, and a relationship $\theta1>\theta2>\theta3$ is established, where $\theta1$ represents a contact angle of the ink ejection surface with respect to water, $\theta2$ represents a contact angle of the cleaning liquid supply member with respect to water, and $\theta3$ represents a contact angle of the hydrophilic region with respect to water.

10. The recording head, according to claim 1, wherein the cleaning liquid supply surface is partitioned along the wiping direction into a first region including the cleaning liquid supply ports, a second region adjacent to the first region on an upstream side with respect to the wiping direction, and a third region adjacent to the first region on a downstream side with respect to the wiping direction, the first region has a hydrophilic property higher than those of the second region and the third region, and the second region has a hydrophilic property equal to or lower than that of the third region.

11. The recording head according to claim 10, wherein the first region has a contact angle of less than 90° with respect to water.

12. The recording head according to claim 11, wherein the first region has a contact angle of 50° or less with respect to water.

13. The recording head according to claim 10, wherein the second region and the third region each have a contact angle of 90° or more with respect to water.

14. The recording head according to claim 13, wherein the second region and the third region each have a contact angle with respect to water higher by 80° or more than that of the first region.

15. An ink-jet recording apparatus comprising the recording head according to claim 1.

16. A recording head, comprising:

an ink ejection surface that includes a nozzle region in which a plurality of ink ejection nozzles for ejecting ink onto a recording medium are open; and a cleaning liquid supply surface that is provided, with respect to the nozzle region, on an upstream side in a wiping direction in which a wiper wipes the ink ejection surface, and through which a plurality of cleaning liquid supply ports for supplying a cleaning liquid are open, wherein on the cleaning liquid supply surface, at least in a region including the cleaning liquid supply ports, a hydrophilic region having wettability with respect to water higher than that of the ink ejection surface is formed so as to form a belt shape continuous across an entire region in a width direction thereof orthogonal to the wiping direction, and the hydrophilic region is formed in such a trapezoidal shape as to be widened from an upstream side toward a downstream side in the wiping direction.

17. A recording head, comprising:

an ink ejection surface that includes a nozzle region in which a plurality of ink ejection nozzles for ejecting ink onto a recording medium are open; and a cleaning liquid supply surface that is provided, with respect to the nozzle region, on an upstream side in a wiping direction in which a wiper wipes the ink ejection surface, and through which a plurality of cleaning liquid supply ports for supplying a cleaning liquid are open, wherein on the cleaning liquid supply surface, at least in a region including the cleaning liquid supply ports, a hydrophilic region having wettability with respect to water higher than that of the ink ejection surface is formed substantially evenly across an entire region in a width direction thereof orthogonal to the wiping direction, the cleaning liquid supply surface is partitioned along the wiping direction into a first region including the cleaning liquid supply ports, a second region adjacent to the first region on an upstream side with respect to the wiping direction, and a third region adjacent to the first region on a downstream side with respect to the wiping direction, the first region has a hydrophilic property higher than those of the second region and the third region, and the second region has a hydrophilic property equal to or lower than that of the third region.

* * * * *